US010317118B2

(12) United States Patent
Dai et al.

(10) Patent No.: US 10,317,118 B2
(45) Date of Patent: Jun. 11, 2019

(54) VARIABLE REFRIGERANT VOLUME SYSTEM AND CONTROL METHOD THEREOF

(71) Applicant: GREE ELECTRIC APPLIANCES, INC. OF ZHUHAI, Zhuhai, Guangdong (CN)

(72) Inventors: Wenjie Dai, Guangdong (CN); Shiqiang Zhang, Guangdong (CN); Yihe Zhang, Guangdong (CN); Jianguo Xiong, Guangdong (CN); Kai Yu, Guangdong (CN); Benyong Bao, Guangdong (CN); Weiguo Li, Guangdong (CN)

(73) Assignee: Gree Electric Appliances, Inc. of Zhuhai, Zhuhai, Guangdong (CN)

( * ) Notice: Subject to any disclaimer, the term of this patent is extended or adjusted under 35 U.S.C. 154(b) by 32 days.

(21) Appl. No.: 15/511,080

(22) PCT Filed: Dec. 26, 2014

(86) PCT No.: PCT/CN2014/095124
§ 371 (c)(1),
(2) Date: Mar. 14, 2017

(87) PCT Pub. No.: WO2016/045219
PCT Pub. Date: Mar. 31, 2016

(65) Prior Publication Data

US 2017/0284695 A1 Oct. 5, 2017

(30) Foreign Application Priority Data

Sep. 26, 2014 (CN) ..... 2014 1 0504822

(51) Int. Cl.
*F25B 45/00* (2006.01)
*F24F 11/00* (2018.01)
(Continued)

(52) U.S. Cl.
CPC ..... *F25B 45/00* (2013.01); *F24F 11/00* (2013.01); *F24F 11/89* (2018.01); *F25B 13/00* (2013.01);
(Continued)

(58) Field of Classification Search
CPC ..... F25B 45/00; F25B 2345/00; F25B 2345/001; F25B 2345/002;
(Continued)

(56) References Cited

U.S. PATENT DOCUMENTS 4,972,676 A * 11/1990 Sakai ..... F25B 9/006 62/114
5,297,395 A 3/1994 Ozu et al.
(Continued)

FOREIGN PATENT DOCUMENTS

CN 2811820 Y 8/2006
CN 201348342 Y 11/2009
(Continued)

OTHER PUBLICATIONS

Written Opinion of the International Searching Authority, PCT/CN2014/095124, dated Jun. 19, 2015, Chinese language, 4 pages.
(Continued)

*Primary Examiner* — Jonathan Bradford
(74) *Attorney, Agent, or Firm* — Faegre Baker Daniels LLP

(57) ABSTRACT

A variable refrigerant volume system includes: a compressor; a four-way valve; an indoor unit; a liquid tube, the first end thereof being connected to the indoor unit, the second end thereof being connected to the third valve port of the four-way valve, and a condenser being provided on the liquid tube; a low pressure air pipe, the first end thereof being connected to the indoor unit, and the second end thereof being connected to the fourth valve port of the
(Continued)

four-way valve; a refrigerant adjustment tank, the first port thereof being connected to the liquid tube, the second port thereof being connected to the low pressure air pipe, and the third port thereof optionally communicating with the liquid tube or the low pressure air pipe.

14 Claims, 2 Drawing Sheets

(51) Int. Cl.

| | |
|---|---|
| ***F25B 41/06*** | (2006.01) |
| ***F25B 13/00*** | (2006.01) |
| ***F25B 41/04*** | (2006.01) |
| ***F25B 49/02*** | (2006.01) |
| ***F24F 11/89*** | (2018.01) |

(52) U.S. Cl.
CPC ..... *F25B 41/04* (2013.01); *F25B 41/06* (2013.01); *F25B 49/022* (2013.01); *F25B 2313/02731* (2013.01); *F25B 2345/00* (2013.01); *F25B 2345/001* (2013.01); *F25B 2345/002* (2013.01); *F25B 2345/003* (2013.01); *F25B 2345/006* (2013.01); *F25B 2500/23* (2013.01); *F25B 2500/24* (2013.01)

(58) Field of Classification Search
CPC ..... F25B 2345/003; F25B 2345/006; F25B 2500/23; F25B 2500/24
See application file for complete search history.

(56) References Cited

U.S. PATENT DOCUMENTS

| | | | | |
|---|---|---|---|---|
| 5,784,892 | A | 7/1998 | Reedy | |
| 8,056,348 | B2 * | 11/2011 | Murakami | F25B 13/00 62/149 |
| 2005/0086954 | A1 | 4/2005 | Song et al. | |
| 2013/0312434 | A1 | 11/2013 | Sanhaji | |
| 2015/0377532 | A1 * | 12/2015 | Uselton | F25B 45/00 62/77 |

FOREIGN PATENT DOCUMENTS

| | | | |
|---|---|---|---|
| CN | 102353121 | A | 2/2012 |
| CN | 102353121 | A | 2/2012 |
| CN | 204187758 | U | 3/2015 |
| EP | 0134015 | A2 | 3/1985 |
| EP | 2669606 | A1 | 12/2013 |
| FR | 2641065 | A1 | 6/1990 |
| JP | H0325256 | A | 2/1991 |
| JP | H0432665 | A | 2/1992 |
| JP | H04327770 | A | 11/1992 |
| JP | H074779 | | 1/1995 |

OTHER PUBLICATIONS

Written Opinion of the International Searching Authority, PCT/CN2014/095124, dated Jun. 19, 2015, English translation, 4 pages.
Communication, Supplementary European Search Report, and European Search Opinion, European Patent Office, European Application No. 14902562.9 to Gree Electric Appliances, Inc. of Zhuhai, dated Feb. 21, 2018, 7 pages.
Examination Report No. 1 for Standard Patent Application, IP Australia, Application No. 2014406800 to Gree Electric Appliances, Inc. of Zhuhai, dated Jan. 24, 2018, 6 pages.
International Search Report and Written Opinion (in Chinese language), issued by the State Intellectual Property Office of the Peoples Republic of China, dated Jun. 19, 2015, for International Application No. PCT/CN2014/095124 (includes English translation of the International Search Report); 11 pages.

* cited by examiner

VARIABLE REFRIGERANT VOLUME SYSTEM AND CONTROL METHOD THEREOF

This application is a National Phase entry of PCT Application No. PCT/CN2014/095124, filed Dec. 26, 2014, which claims the benefit of priority to Chinese Patent Application No. 201410504822.3, titled "VARIABLE REFRIGERANT VOLUME SYSTEM AND CONTROL METHOD THEREOF", filed with the Chinese State Intellectual Property Office on Sep. 26, 2014, the entire disclosures of which are incorporated herein by reference.

FIELD

The present application relates to the technical field of air conditioning, and particularly to a variable refrigerant volume system and a control method having the variable refrigerant volume system.

BACKGROUND

With the constant development of the variable refrigerant volume technology, a liquid reservoir, as a device for storing a liquid phase refrigerant condensed by a condenser, is unable to meet the requirement of accuracy for controlling the variable refrigerant volume, and main current manufactures remove the liquid reservoir device on the variable refrigerant volume. Due to the characteristics of the variable refrigerant volume, an outdoor unit is always operated in a partially loaded state, and a common variable refrigerant volume allow part of the refrigerant to be accommodated in volumes of the outdoor unit functioning as a condenser and an indoor unit functioning as an evaporator. However, a heat recycling variable refrigerant volume system, as a dedicated variable refrigerant volume system, is capable of simultaneously operating in two modes, i.e., a refrigerating mode and a heating mode, and the outdoor unit may be switched flexibly to function as a condenser or an evaporator according to the system mode, thus, there may be many working situations. The working conditions of the two heat exchangers may both be disadvantageous to the storage of the refrigerant, thus, an additional refrigerant adjustment mechanism may be very necessary.

Some conventional air-conditioning apparatuses have a similar device, however, the controlling is simple and the device is not adapted to the variable refrigerant volume system. Accordingly, a refrigerant adjustment device dedicated for the heat recycling variable refrigerant volume system is required, which can be controlled flexibly according to the operating condition of the refrigerant, and further ensures the reliability of the system.

SUMMARY

A variable refrigerant volume system and a method for controlling the variable refrigerant volume system are provided according to embodiments of the present application, which can control a refrigerant circulation volume flexibly according to the operating condition of the refrigerant, and ensure reliability of the system.

To address the above technical issues, a variable refrigerant volume system is provided according to an embodiment of the present application, which includes: a compressor, a four-way valve, an indoor unit, a liquid tube, a low-pressure pipe and a refrigerant adjustment tank. Specifically, an inlet of the compressor is connected to a first valve port of the four-way valve, and an outlet of the compressor is connected to a second valve port of the four-way valve. The liquid tube has a first end connected to the indoor unit and a second end connected to a third valve port of the four-way valve, and a condenser is provided on the liquid tube. The low-pressure pipe has a first end connected to the indoor unit and a second end connected to a fourth valve port of the four-way valve. The refrigerant adjustment tank has a first port connected to the liquid tube, a second port communicating with the low-pressure pipe, and a third port selectively communicating with the liquid tube or the low-pressure pipe, which is configured to provide refrigerant to the variable refrigerant volume system in the case that the variable refrigerant volume system requires more refrigerant, and recycle refrigerant from the variable refrigerant volume system in the case that the variable refrigerant volume system requires less refrigerant.

Preferably, the variable refrigerant volume system further includes: a mode converter connected to the indoor unit and configured to convert the mode of the refrigerant; and a high-pressure pipe, wherein the high-pressure pipe has a first end connected to the mode converter and a second end connected to the second valve port of the four-way valve. The first end of the liquid tube and the first end of the low-pressure pipe are both connected to the mode converter; and the second port of the refrigerant adjustment tank selectively communicates with the low-pressure pipe or the high-pressure pipe.

Preferably, a liquid inlet electromagnetic valve for controlling opening and closing communication of the pipeline is provided on a pipeline between the first port of the refrigerant adjustment tank and the liquid tube.

Preferably, a liquid inlet one-way valve for preventing the refrigerant from flowing to the liquid tube from the refrigerant adjustment tank is further provided on the pipeline between the first port of the refrigerant adjustment tank and the liquid tube.

Preferably, a pressurizing valve is provided on a pipeline between the second port of the refrigerant adjustment tank and the high-pressure pipe and is configured to pressurize an interior of the refrigerant adjustment tank.

Preferably, a high-pressure unloading valve arranged in parallel with the pressurizing valve is further provided on the pipeline between the second port of the refrigerant adjustment tank and the high-pressure pipe.

Preferably, a high-pressure pipe one-way valve is provided on the high-pressure pipe for preventing the refrigerant from flowing to the second valve port of the four-way valve from the indoor unit, and the pipeline between the second port of the refrigerant adjustment tank and the high-pressure pipe is connected to an inlet end of the high-pressure pipe one-way valve.

Preferably, a pressure equalizing valve is provided on a pipeline between the second port of the refrigerant adjustment tank and the low-pressure pipe.

Preferably, a main pipe is connected to the third port of the refrigerant adjustment tank, and the main pipe is connected to the low-pressure pipe via a first branch pipe, and is connected to the liquid tube via a second branch pipe connected in parallel with the first branch pipe. A refrigerating liquid outlet valve is provided on the first branch pipe and is configured to control opening and closing communication of the first branch pipe, and a heating liquid outlet valve is provided on the second branch pipe and is configured to control opening and closing communication of the second branch pipe. The second branch pipe is connected to a pipeline between the condenser and the indoor unit.

Preferably, a third branch pipe is further connected to the main pipe, the third branch pipe is connected to the liquid tube, and a pressure unloading valve is provided on the third branch pipe.

Preferably, a capillary tube is provided on the main pipe.

Preferably, a gas-liquid separator is further connected between the compressor and the low-pressure pipe.

According to another aspect of the present application, a method for controlling the variable refrigerant volume system is provided, which includes: step S1, detecting a requirement condition of the variable refrigerant volume system for refrigerant; step S2, controlling a refrigerant adjustment tank to provide refrigerant to the variable refrigerant volume system for circulation when a required volume of refrigerant is greater than a preset value; step S3, controlling the refrigerant adjustment tank to recycle excessive refrigerant from the variable refrigerant volume system when a required volume of refrigerant is less than the preset value.

Preferably, step S2 includes: in the case that the variable refrigerant volume system is mainly in a refrigerating mode, communicating the refrigerant adjustment tank to the low-pressure pipe and pressurizing the refrigerant adjustment tank to allow the refrigerant to enter the low-pressure pipe from the refrigerant adjustment tank; and in the case that the variable refrigerant volume system is mainly in a heating mode, communicating the refrigerant adjustment tank to the liquid tube, and pressurizing the refrigerant adjustment tank to allow the refrigerant to enter a condenser from the refrigerant adjustment tank.

Preferably, step S3 includes: communicating the refrigerant adjustment tank to the liquid tube, equalizing the pressure between the refrigerant adjustment tank and the low-pressure pipe and allowing the excessive refrigerant to enter the interior of the refrigerant adjustment tank.

With the technical solution of the present application, the variable refrigerant volume system includes: the compressor, the four-way valve, the indoor unit, the liquid tube, the low-pressure pipe and the refrigerant adjustment tank. Specifically, an inlet of the compressor is connected to a first valve port of the four-way valve, and an outlet of the compressor is connected to a second valve port of the four-way valve. The liquid tube has a first end connected to the indoor unit and a second end connected to a third valve port of the four-way valve, and a condenser is provided on the liquid tube. The low-pressure pipe has a first end connected to the indoor unit and a second end connected to a fourth valve port of the four-way valve. The refrigerant adjustment tank has a first port connected to the liquid tube, a second port communicating with the low-pressure pipe, and a third port selectively communicating with the liquid tube or the low-pressure pipe, and is configured to provide refrigerant to the variable refrigerant volume system in the case that the variable refrigerant volume system requires more refrigerant, and recycle refrigerant from the variable refrigerant volume system in the case that the variable refrigerant volume system requires less refrigerant. During the operation of the variable refrigerant volume system, the volume of the refrigerant, participating the circulation, of the variable refrigerant volume system may be adjusted by the refrigerant adjustment tank according to the required volume of the refrigerant, and when the variable refrigerant volume system requires more refrigerant, and the refrigerant adjustment tank provides refrigerant to the variable refrigerant volume system; and when the variable refrigerant volume system requires less refrigerant, the refrigerant adjustment tank recycles refrigerant from the variable refrigerant volume system. The operation is flexible and convenient and the volume of refrigerant circulating in the system can be always maintained appropriate. Therefore, the operation efficiency of the system can be effectively improved and the operation reliability of the system can be effectively ensured.

Figure 1:
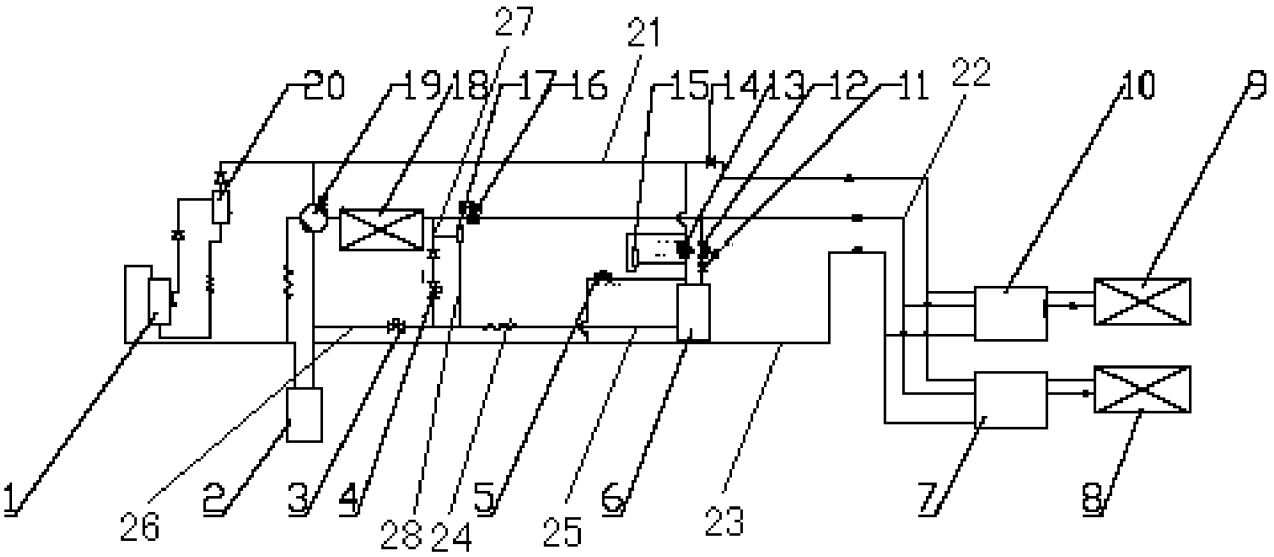
FIG. 1 is a diagram of the working principle of a variable refrigerant volume system according to an embodiment of the present application.
Figure 2:
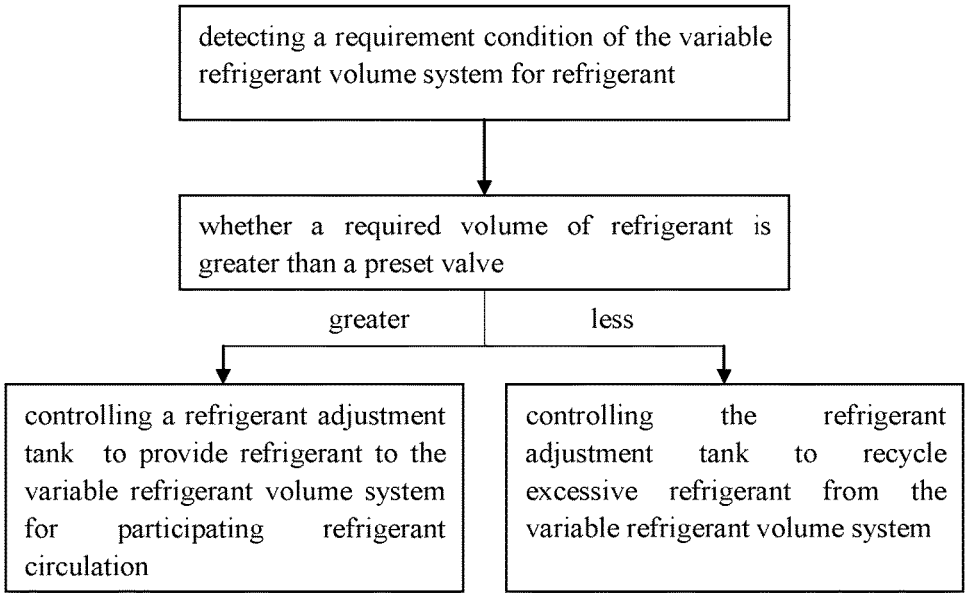
FIG. 2 is a control flow chart of the variable refrigerant volume system according to the embodiment of the present application.

Reference numbers in FIGS. 1 and 2:

| | | | |
|---|---|---|---|
| 1 | compressor, | 2 | gas-liquid separator, |
| 3 | refrigerating liquid outlet valve, | 4 | heating liquid outlet valve, |
| 5 | pressure equalizing valve, | 6 | refrigerant adjustment tank, |
| 7 | first mode converter, | 8 | first indoor unit, |
| 9 | second indoor unit, | 10 | second mode converter, |
| 11 | liquid inlet one-way valve, | 12 | liquid inlet electromagnetic valve, |
| 13 | pressurizing valve, | 14 | high-pressure pipe one-way valve, |
| 15 | high-pressure unloading valve, | 16 | electronic expansion valve, |
| 17 | pressure unloading valve, | 18 | condenser, |
| 19 | four-way valve, | 20 | oil separator, |
| 21 | high-pressure air pipe, | 22 | liquid tube, |
| 23 | low-pressure air pipe, | 24 | capillary tube, |
| 25 | main pipe, | 26 | first branch pipe, |
| 27 | second branch pipe, and | 28 | third branch pipe. |

DETAILED DESCRIPTION

The present application is further described in detail hereinafter in conjunction with drawings and embodiments, which should not be interpreted as limitation to the scope of the present application.

Referring to FIG. 1, according to an embodiment of the present application, a variable refrigerant volume system includes: a compressor 1; a four-way valve 19, wherein an inlet of the compressor 1 is connected to a first valve port of the four-way valve 19, and an outlet of the compressor is connected to a second valve port of the four-way valve 19; an indoor unit; a liquid tube 22, wherein the liquid tube 22 has a first end connected to the indoor unit and a second end connected to a third valve port of the four-way valve 19, and a condenser 18 is provided on the liquid tube 22; a low-pressure pipe 23, wherein the low-pressure pipe 23 has a first end connected to the indoor unit and a second end connected to a fourth valve port of the four-way valve 19; a refrigerant adjustment tank 6, wherein the refrigerant adjustment tank 6 has a first port connected to the liquid tube 22, a second port communicating with the low-pressure pipe 23, and a third port selectively communicating with the liquid tube 22 or the low-pressure pipe 23, and the refrigerant adjustment tank 6 is configured to provide refrigerant to the variable refrigerant volume system in the case that the variable refrigerant volume system requires more refrigerant volume, and recycles refrigerant from the variable refrigerant volume system in the case that the variable refrigerant volume system requires less refrigerant volume.

During the operation of the variable refrigerant volume system, the volume of the refrigerant, participating the circulation, of the variable refrigerant volume system may be adjusted by the refrigerant adjustment tank 6 according to the required volume of the refrigerant. In the case that the variable refrigerant volume system requires more refrigerant, high pressure may be provided to the refrigerant adjustment tank 6, which allows the refrigerant adjustment tank 6 to provide refrigerant to the variable refrigerant volume system via the low-pressure pipe 23, and ensures sufficient refrigerant to participate in the refrigerant circulation. In the case that the variable refrigerant volume system requires less refrigerant, the pressure in the refrigerant adjustment tank 6 may be decreased to allow the high-pressure refrigerant in the liquid tube 22 to flow into the refrigerant adjustment tank 6 in a low pressure, thus the refrigerant in the variable refrigerant volume system is recycled, which allows the excessive refrigerant in the variable refrigerant volume system to be stored in the refrigerant adjustment tank 6. When the variable refrigerant volume system performs the refrigerant adjustment, the operation is flexible and convenient and the volume of refrigerant circulating in the system can be always maintained appropriate. Therefore, the operation efficiency of the system can be effectively improved and the operation reliability of the system can be effectively ensured.

The variable refrigerant volume system may further include: a mode converter which is connected to the indoor unit and configured to convert a mode of the refrigerant; and a high-pressure pipe 21, wherein the high-pressure pipe 21 has a first end connected to the mode converter and a second end connected to the second valve port of the four-way valve 19. The first end of the liquid tube 22 and the first end of the low-pressure pipe 23 are both connected to the mode converter; and the second port of the refrigerant adjustment tank 6 selectively communicates with the low-pressure pipe 23 or the high-pressure pipe 21.

In this embodiment, the indoor unit includes a first indoor unit 8 and a second indoor unit 9. The mode converter includes a first mode converter 7 and a second mode converter 10. The first indoor unit 8 and the first mode converter 7 are combined to form a first indoor unit system, and the second indoor unit 9 and the second mode converter 10 are combined to form a second indoor unit system. The first indoor unit system and the second indoor unit system are connected in parallel to the high-pressure pipe 21, the liquid tube 22 and the low-pressure pipe 23. The number of the indoor units is not limited to two, and may also be more than two, and each of the indoor units has a mode converter matching therewith.

The mode converter may convert the mode of the refrigerant provided by the outdoor unit system, and then convey the converted refrigerant into the indoor unit. While the heat recycle variable refrigerant volume system is operating, the outdoor unit system can provide refrigerants in three states simultaneously. The high-pressure pipe 21 is configured to provide a high-pressure gaseous refrigerant. The high-pressure gaseous refrigerant enters the indoor unit system from the high-pressure pipe. After being controlled by the mode converter, the high-pressure gaseous refrigerant can be provided to the indoor unit as a high-pressure heat source. The liquid tube 22 is configured to provide a high-pressure liquid refrigerant, which is a refrigerant cooled by the condenser 18. The high-pressure liquid refrigerant can be provided to the refrigerant, after being controlled by the mode converter, as a refrigerant heat source before being throttled. The low-pressure pipe 23 is a refrigerant pipeline through which the refrigerant returns to the outdoor unit after refrigerating or heating via the indoor unit. The three pipelines can provide three kinds of refrigerants to the indoor unit for selection after being controlled by the mode converter. The high-pressure pipe 21 and the liquid tube 22 can be selected to form a heating circuit for heating; and, the liquid tube 22 and the low-pressure pipe 23 can be selected to form a refrigerating circuit for refrigerating. Thus, the operating performance of the variable refrigerant volume system is improved, the operation modes of the variable refrigerant volume system are increased, the adaptability of the variable refrigerant volume system is better, and the performance is more excellent.

A liquid inlet electromagnetic valve 12 is provided on a pipeline between the first port of the refrigerant adjustment tank 6 and the liquid tube 22, which is configured to control opening and closing communication of the pipeline. The liquid inlet electromagnetic valve 12 can be opened in the case that the refrigerant adjustment tank 6 is required to recycle the refrigerant, which allows the high-pressure refrigerant in the liquid tube 22 to enter the refrigerant adjustment tank 6 via the liquid inlet electromagnetic valve 12.

Preferably, a liquid inlet one-way valve 11 is further provided on the pipeline between the first port of the refrigerant adjustment tank 6 and the liquid tube 22, which is configured to prevent the refrigerant from flowing from the refrigerant adjustment tank 6 to the liquid tube 22. An electronic expansion valve 16 is generally further provided on the liquid tube 22 between the condenser 18 and the indoor unit, and an outlet end of the liquid inlet one-way valve 11 is connected to the liquid tube 22 between the electronic expansion valve 16 and the indoor unit. The liquid inlet one-way valve 11 and the liquid inlet electromagnetic valve 12 are used in combination, which thereby effectively prevents the high-pressure refrigerant from directly flowing into the liquid tube 22 from the refrigerant adjustment tank 6 and improves the security and reliability of the system.

Preferably, a pressurizing valve 13 is provided on a pipeline between the second port of the refrigerant adjustment tank 6 and the high-pressure pipe 21, which is configured to pressurize an interior of the refrigerant adjustment tank 6. The pressurizing valve 13 may also be located at other positions as long as the pressurizing valve 13 can increase the pressure in the refrigerant adjustment tank 6 so as to allow refrigerant to flow out of the refrigerant adjustment tank 6 and participate the refrigerant circulation. The pressurizing valve 13 herein may also be other pressure adjustment devices, thus, the pressure of the refrigerant in the refrigerant adjustment tank 6 can be increased or decreased according to the required volume of the refrigerant participating the circulation. The pressurizing valve 13 may also be replaced by other pressurizing devices.

A high-pressure unloading valve 15 connected in parallel with the pressurizing valve 13 is further provided on the pipeline between the second port of the refrigerant adjustment tank 6 and the high-pressure pipe 21, and the high-pressure unloading valve 15 can relief the pressure of the refrigerant adjustment tank 6 as required, and can change the pressure in the refrigerant adjustment tank 6 as desired in cooperation with the pressurizing valve 13, which allows the use of the refrigerant adjustment tank 6 to be more flexible and convenient.

A high-pressure pipe one-way valve 14 is provided on the high-pressure pipe 21 for preventing the refrigerant from flowing to the second valve port of the four-way valve 19 from the indoor unit. The pipeline between the second port of the refrigerant adjustment tank 6 and the high-pressure pipe 21 is connected to an inlet end of the high-pressure pipe one-way valve 14. The high-pressure pipe one-way valve 14 can prevent the high-pressure gaseous refrigerant in the high-pressure pipe 21 from flowing back, which improves the working reliability of the variable refrigerant volume system.

Preferably, a pressure equalizing valve 5 is provided on the pipeline between the second port of the refrigerant adjustment tank 6 and the low-pressure pipe 23, and the pressure equalizing valve 5 enables the interior of the refrigerant adjustment tank 6 to be always in communication with a low-pressure part, which facilitates the refrigerant entering the interior of the refrigerant adjustment tank 6 from a high-pressure part. The pressure equalizing valve 5 can also be replaced by other structures which can generate low pressure in the refrigerant adjustment tank 6.

A main pipe 25 is connected to the third port of the refrigerant adjustment tank 6, and the main pipe 25 is connected to the low-pressure pipe 23 via a first branch pipe 26, and is connected to the liquid tube 22 via the second branch pipe 27 connected in parallel with the first branch pipe 26. A refrigerating liquid outlet valve 3 is provided on the first branch pipe 26 for controlling whether the first branch pipe is cut off. A heating liquid outlet valve 4 is provided on the second branch pipe 27 for controlling whether the second branch pipe is cut off. The second branch pipe 27 is connected to a pipeline between the condenser 18 and the indoor unit.

Preferably, a third branch pipe 28 is further connected to the main pipe 25, and the third branch pipe 28 is connected to the liquid tube 22. A pressure unloading valve 17 is provided on the third branch pipe 28, and the pressure unloading valve 17 may adjust the pressure of the refrigerant entering the condenser 18, so as to allow the refrigerant flowing from the refrigerant adjustment tank 6 to more easily flow into the condenser 18 through the heating liquid outlet valve 4 and further participate the circulation.

Preferably, a capillary tube 24 is provided on the main pipe 25, and the capillary tube 24 may control the flow rate of the refrigerant flowing from the refrigerant adjustment tank 6 to the liquid tube 22 or the low-pressure pipe 23, thereby improving the accuracy of the flow rate of the refrigerant suctioned by the compressor 1, ensuring the efficient operating of the compressor 1 and improving the working performance and the energy efficiency ratio of the variable refrigerant volume system.

A gas-liquid separator 2 is further connected between an inlet end of the compressor 1 and the low-pressure pipe 23, and the low-pressure pipe 23 is connected to the gas-liquid separator 2. An oil separator 20 is further provided at an outlet end of the compressor 1.

Referring to FIG. 2, a control method of a variable refrigerant volume system according to an embodiment of the present application includes steps one to three as follows. In step one, a requirement condition of refrigerant of the variable refrigerant volume system is detected; in step two, in the case that a required volume of refrigerant is greater than a preset value, a refrigerant adjustment tank 6 is controlled to provide refrigerant to the variable refrigerant volume system to participate the refrigerant circulation; and in step three, in the case that a required volume of refrigerant is less the preset value, the refrigerant adjustment tank 6 is controlled to recycle excessive refrigerant from the variable refrigerant volume system. The required volume of the refrigerant may be determined by detecting whether the temperature of the exhaust gas is too high, whether the opening of the throttling electronic expansion valve is large and other aspects, and the required volume of the refrigerant participating in the circulation may also be determined by other ways. For different preset values, the required volumes of the refrigerant participating the circulation may also be different, however, it should fall into the scope of the present application as long as the control principle thereof is the same with the present application.

Step S2 includes that: in the case that the variable refrigerant volume system is mainly in a refrigerating mode, the refrigerant adjustment tank 6 is communicated with the low-pressure pipe 23 and is pressurized therein to allow the refrigerant to enter the low-pressure pipe 23 from the refrigerant adjustment tank 6; and in the case that the variable refrigerant volume system is mainly in a heating mode, the refrigerant adjustment tank 6 is communicated with the liquid tube 22 and is pressurized therein to allow the refrigerant to enter the condenser 18 from the refrigerant adjustment tank 6.

Step S3 includes that: the refrigerant adjustment tank 6 is communicated with the liquid tube 22 and the pressure is equalized between the refrigerant adjustment tank 6 and the low-pressure pipe 23, so as to allow excessive refrigerant to enter the interior of the refrigerant adjustment tank 6.

The working process of the variable refrigerant volume system is described as follows.

When it is detected that the variable refrigerant volume system requires less refrigerant, the refrigerant adjustment tank 6 is controlled to liquid supply, the liquid inlet electromagnetic valve 12 and the pressure equalizing valve 5 may be turned on by the controller, and since the pressure equalizing valve 5 can always communicate the interior of the refrigerant adjustment tank 6 to a low pressure, the pressure in the refrigerant adjustment tank 6 is allowed to be lower than the pressure of the refrigerant in the liquid tube 22. Thus, the high-pressure refrigerant in the liquid tube 22 enters the refrigerant adjustment tank 6 after passing through the liquid inlet electromagnetic valve 12 and is stored in the refrigerant adjustment tank 6.

When it is detected that the variable refrigerant volume system requires more refrigerant, or the operating load of the system is changed, the refrigerant adjustment tank 6 is required to discharge the refrigerant stored therein to the outdoor unit system, and in this case, the system can be controlled differently in different operating modes.

In the case that majority units of the system operate in the refrigerating mode (i.e., in the case that the system is mainly in the refrigerating mode), the superheat degree of the indoor unit is controlled by the electronic expansion valve 16 of the indoor unit and meanwhile pipelines exchange heat continuously, therefore liquid back flowing is not apt to occur in the system, and at this time, the refrigerant adjustment tank 6 opens the refrigerating liquid outlet valve 3 and the pressurizing valve 13, which allows high pressure to be introduced into the refrigerant adjustment tank 6, such that the refrigerant in the refrigerant adjustment tank 6 is at a high pressure, and flows from the refrigerant adjustment tank 6 to an interior of the gas-liquid separator 2, which allows the refrigerant in the refrigerant adjustment tank 6 to participate the circulation of the refrigerant, and ensures sufficient volume of refrigerant to participate the circulation while the system is operating.

In the case that majority indoor units of the system operate in the heating mode (i.e., in the case that the system is mainly in the heating mode), the outdoor unit is mainly in a low pressure state. Since the condenser 18 has problems such as frosting and a poor heat exchanging condition, backflow of liquid is apt to occur in the system, which adversely affects the reliability of the compressor 1. In this case, the refrigerant in the refrigerant adjustment tank 6 does not enter the gas-liquid separator 2 through the refrigerating liquid outlet valve 3 to further increase the pressure of back flowing of liquid of the gas-liquid separator 2 anymore, instead, the heating liquid outlet valve 4 and the pressurizing valve 13 are opened, such that the refrigerant in the refrigerant adjustment tank 6 enters the inlet portion of the condenser 18, and the refrigerant may be exchanged heat by the condenser 18 and then enters the gas-liquid separator 2, thus the volume of the refrigerant exchanging heat with the condenser 18 may be increased, the efficiency of heat exchanging is improved, the object of improving the heat exchanging capacity and energy efficiency is achieved, meanwhile the hidden trouble of backflow of liquid on reliability of the system may be eliminated.

The above description is only exemplary embodiments of the present application. It should be noted that, for the person skilled in the art, a few of modifications and improvements may be made to the present application without departing from the principle of the present application. The scope of the present application is defined by the claims.

The invention claimed is:

1. A variable refrigerant volume system, comprising:

a compressor;

a four-way valve; wherein an inlet of the compressor is connected to a first valve port of the four-way valve, and an outlet of the compressor is connected to a second valve port of the four-way valve;

an indoor unit;

a liquid tube; wherein the liquid tube has a first end connected to the indoor unit and a second end connected to a third valve port of the four-way valve, and a condenser is provided on the liquid tube;

a low-pressure pipe; wherein the low-pressure pipe has a first end connected to the indoor unit and a second end connected to a fourth valve port of the four-way valve; and a refrigerant adjustment tank; wherein the refrigerant adjustment tank has a first port connected to the liquid tube, a second port communicating with the low-pressure pipe, and a third port selectively communicating with the liquid tube or the low-pressure pipe, and the refrigerant adjustment tank is configured to provide refrigerant to the variable refrigerant volume system in the case that the variable refrigerant volume system requires more refrigerant, and recycle refrigerant from the variable refrigerant volume system in the case that the variable refrigerant volume system requires less refrigerant.

2. The variable refrigerant volume system according to claim 1, further comprising:

a high-pressure pipe, wherein the high-pressure pipe has a first end connected to the second valve port of the four-way valve, and the second port of the refrigerant adjustment tank selectively communicates with the low-pressure pipe or the high-pressure pipe.

3. The variable refrigerant volume system according to claim 2, wherein a liquid inlet electromagnetic valve for controlling opening and closing communication of a pipeline is provided on a pipeline between the first port of the refrigerant adjustment tank and the liquid tube.

4. The variable refrigerant volume system according to claim 3, wherein a liquid inlet one-way valve for preventing the refrigerant from flowing to the liquid tube from the refrigerant adjustment tank is further provided on the pipeline between the first port of the refrigerant adjustment tank and the liquid tube.

5. The variable refrigerant volume system according to claim 2, wherein a pressurizing valve for pressurizing an interior of the refrigerant adjustment tank is provided on a pipeline between the second port of the refrigerant adjustment tank and the high-pressure pipe.

6. The variable refrigerant volume system according to claim 5, wherein a high-pressure unloading valve arranged in parallel with the pressurizing valve is further provided on the pipeline between the second port of the refrigerant adjustment tank and the high-pressure pipe.

7. The variable refrigerant volume system according to claim 6, wherein a high-pressure pipe one-way valve is provided on the high-pressure pipe for preventing the refrigerant from flowing to the second valve port of the four-way valve from the indoor unit, and the pipeline between the second port of the refrigerant adjustment tank and the high-pressure pipe is connected to an inlet end of the high-pressure pipe one-way valve.

8. The variable refrigerant volume system according to claim 2, wherein a pressure equalizing valve is provided on a pipeline between the second port of the refrigerant adjustment tank and the low-pressure pipe.

9. The variable refrigerant volume system according to claim 1, wherein a main pipe is connected to the third port of the refrigerant adjustment tank, the main pipe is connected to the low-pressure pipe via a first branch pipe and is connected to the liquid tube via a second branch pipe connected in parallel with the first branch pipe, and a refrigerating liquid outlet valve is provided on the first branch pipe for controlling opening and closing communication of the first branch pipe, a heating liquid outlet valve is provided on the second branch pipe for controlling opening and closing communication of the second branch pipe, and the second branch pipe is connected to a pipeline between the condenser and the indoor unit.

10. The variable refrigerant volume system according to claim 9, wherein a third branch pipe is further connected to the main pipe, the third branch pipe is connected to the liquid tube, and a pressure unloading valve is provided on the third branch pipe.

11. The variable refrigerant volume system according to claim 9, wherein a capillary tube is provided on the main pipe.

12. The variable refrigerant volume system according to claim 1, wherein a gas-liquid separator is further connected between the compressor and the low-pressure pipe.

13. A control method of a variable refrigerant volume system, comprising:

step one, detecting a requirement condition of the variable refrigerant volume system for refrigerant;

step two, controlling a refrigerant adjustment tank to provide refrigerant to the variable refrigerant volume system for circulation in the case that a required volume of refrigerant is greater than a specific value; wherein the step two comprises: in the case that the variable refrigerant volume system is mainly in a refrigerating mode, communicating the refrigerant adjustment tank with a low-pressure pipe and pressurizing the refrigerant adjustment tank to allow the refrigerant to enter the low-pressure pipe from the refrigerant adjustment tank; and in the case that the variable refrigerant volume system is mainly in a heating mode, communicating the refrigerant adjustment tank with the liquid tube, and pressurizing the refrigerant adjustment tank to allow the refrigerant to enter a condenser from the refrigerant adjustment tank;

step three, controlling the refrigerant adjustment tank to recycle excessive refrigerant from the variable refrigerant volume system in the case that a required volume of refrigerant is less than the specific value.

14. The method for controlling the variable refrigerant volume system according to claim 13, wherein the step three comprises:

communicating the refrigerant adjustment tank with the liquid tube, and equalizing the pressure between the refrigerant adjustment tank and the low-pressure pipe to allow excessive refrigerant to enter the interior of the refrigerant adjustment tank.

* * * * *